US005926885A

United States Patent [19]

Williams

[11] Patent Number: 5,926,885

[45] Date of Patent: Jul. 27, 1999

[54] COMBINATION CHISEL AND PUNCH

[75] Inventor: Luther L. Williams, Maryville, Tenn.

[73] Assignee: Clark & Williams L.L.C., Sevierville, Tenn.

[21] Appl. No.: 08/936,214

[22] Filed: Sep. 24, 1997

[51] Int. Cl.[6] ..... B25B 15/00; B25B 23/00; B25G 15/00

[52] U.S. Cl. ..... 7/165; 7/168; 81/440

[58] Field of Search ..... 7/118, 158, 165, 7/168; 81/437, 440, 44, 125, 451; 30/167, 168, 167.1; 125/40, 41

[56] References Cited

U.S. PATENT DOCUMENTS

| | | | |
|---|---|---|---|
| 801,791 | 10/1905 | Herwig . | |
| 3,328,999 | 7/1967 | Peterson et al. | 72/388 |
| 4,648,145 | 3/1987 | Miceli et al. . | |
| 4,848,197 | 7/1989 | Kikel | 81/440 |
| 5,062,173 | 11/1991 | Collins et al. . | |
| 5,220,701 | 6/1993 | Creato et al. . | |
| 5,526,723 | 6/1996 | Sormunen et al. | 81/487 |
| 5,542,139 | 8/1996 | Boivin . | |
| 5,553,340 | 9/1996 | Brown, Jr. | 7/118 |

*Primary Examiner*—David A. Scherbel
*Assistant Examiner*—Philip J. Hoffmann
*Attorney, Agent, or Firm*—Pitts & Brittian, P.C.

[57] ABSTRACT

A combination chisel and punch for using one tool as a handle while striking another tool is provided. The combination tool includes multiple tool members with a striking end for being struck by another object and a working end for engaging a work piece. The tool members are pivotally connected by a link. A locking mechanism secures one tool member, serving as a handle, in an orientation parallel to the link while the user strikes another tool member, serving as a tool. When not in use, each tool member folds into an unlocked position for compact storage.

14 Claims, 5 Drawing Sheets

COMBINATION CHISEL AND PUNCH

TECHNICAL FIELD

This invention relates to the field of multifunction hand tools. More specifically, the present invention relates to a combination chisel and punch, designed to be struck by another object, such as a hammer.

BACKGROUND ART

Certain multifunction or combination tools are well known. Many multifunction tools contain pointed tool members which can be used to punch or chisel, but few have a surface upon which to strike the tool member. Other tools include a striking surface, especially single function chisels and punches, but the method of deployment often exposes the hand to the danger of missing the striking surface or sharp edges.

Other devices have been produced to accommodate multiple tools in a single device. Typical of the art are those devices disclosed in the following U.S. patents:

| U.S. Pat. No. | Inventor(s) | Issue Date |
|---|---|---|
| 801,791 | G. J. Herwig | Oct. 10, 1905 |
| 4,648,145 | P. V. Miceli | Mar. 10, 1987 |
| 5,062,173 | M. C. Collins, et al. | Nov. 5, 1991 |
| 5,220,701 | T. F. Creato, et al. | Jun. 22, 1993 |
| 5,542,139 | G. E. Boivin | Aug. 6, 1996 |

U.S. Pat. Nos. 801,791; and 5,542,139 describe tools containing multiple tool members which fold into a handle for compact storage. However, none of the above mentioned patents include, or are designed to include, a tool member with a surface to allow an external striking force to be applied.

U.S. Pat. No. 5,220,701 discloses a multifunction tool designed specifically for a painter and includes a folding poker for piercing the seal on a tube of caulk. Such poker is a long, thin tool member not capable of withstanding an external striking force. Accordingly, the tool does not anticipate nor include a striking surface.

U.S. Pat. No. 4,648,145 discloses a device which includes a punch attachment. However, like the aforementioned patents, it does not include a striking surface to allow increased force to be applied to the punch. Instead, the tool end opposing the punch attachment is designed to operate as the blade of a screwdriver. Further, the device does not provide a means for supporting the punch while keeping the operator's hand a safe distance from the surface to be struck.

Although the prior art referenced provides a number of tools with multiple tool members, none of the prior art combination tools anticipate the use of an external object, such as a hammer, to increase the amount of force applied to the tool. Common to each of the prior art combination tools is the lack of a surface for striking to increase the downward force applied to a given tool member. Further, were a user attempt to apply an external striking force to one of the prior art combination tools, those tools do not provide a means for the user to support the tool member and keep the hand away from the chosen striking surface.

Accordingly, an object of the present invention is to provide a combination tool device having a striking surface upon which the tool member can be struck by another object, such as a hammer.

Another object of the present invention is to provide a combination tool device for holding each tool member while keeping the hand away from the striking surface.

Another object of the present invention is to provide a combination tool device that folds for compact storage.

DISCLOSURE OF THE INVENTION

In accordance with the present invention, there is provided a combination tool device, which includes at least elongated two tool members, such as a chisel tool member and punch tool member, allowing the first tool member to be used as a handle to steady the second tool member and to keep the hand away from a striking surface, defined by the second tool member, and vice versa. A link connects the first and second tool members. Each tool member pivots around a link pin passing through the tool member and the link. Either tool member may be selected for use by placing it in an operative position and exposing a striking surface, with the other tool member locked into an extended position for use as a handle. The locking mechanism consists of at least one ball-bearing biased by a corresponding spring. Locking occurs when the outer surface of the ball-bearing is received by a recess. When not in use, both the first and second tool members can be folded into an unlocked position for compact storage.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

A combination chisel and punch incorporating various features of the present invention is illustrated generally at 10 in the figures. The combination chisel and punch 10 is provided for using one tool as a handle while another tool is being struck. To this extent, the combination chisel and punch 10 is provided with at least two elongated tool members 12.

Figure 1:
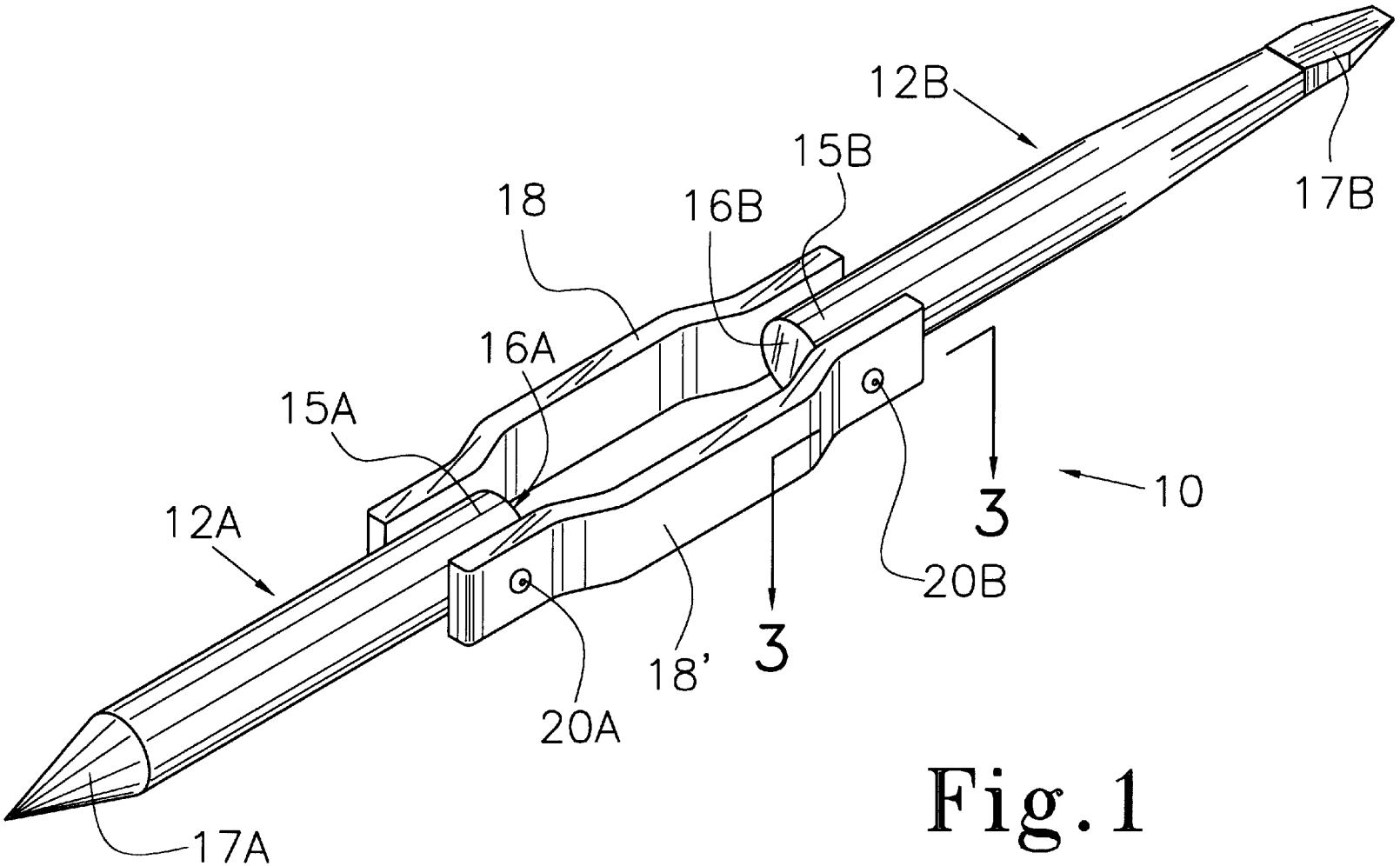
FIG. 1 is a perspective view of the combination chisel and punch constructed in accordance with several features of the present invention.

Referring now to FIG. 1, a first tool member 12A and a second tool member 12B. Corresponding elements of each tool member 12 are labeled with like numerals. Specifically, the element numbers corresponding to the first tool member 12A end with the designation "A" and those corresponding to the second tool member 12B end with the designation "B". Each tool member 12 defines a striking end 15 for being struck by another object, such as a hammer, and a working end 17 for engaging a work piece. Further, each striking end 15 defines a striking surface 16. One skilled in the art will recognize that the striking end 15 can include variations to enhance its function. For example, the diameter of the striking end 15 can be made larger than the diameters of the tool member 12 to provide a larger striking surface 16.

Further, one skilled in the art will recognize that variations of the striking surface 16 can enhance its function, such as adding a texture to minimize slippage. The working end 17 of each tool member 12 defines a specified tool, such as a chisel or punch tool. One skilled in the art will recognize that variations in the size and shape of chisels and punches allow for modifications such as a double-chisel or a double-punch combination. Additionally, one skilled in the art will recognize that multiple tool members 12 could be attached at either end of a pair of link members 18, 18'. The first link member 18 is disposed on a first side of the tool members 12 and the second link member 18' disposed on a second side of the tool members 12. Corresponding elements on either side of the combination chisel and punch 10 are labeled with like numerals with the elements numbers corresponding to elements disposed on the second side ending with the designation.

Figure 2:
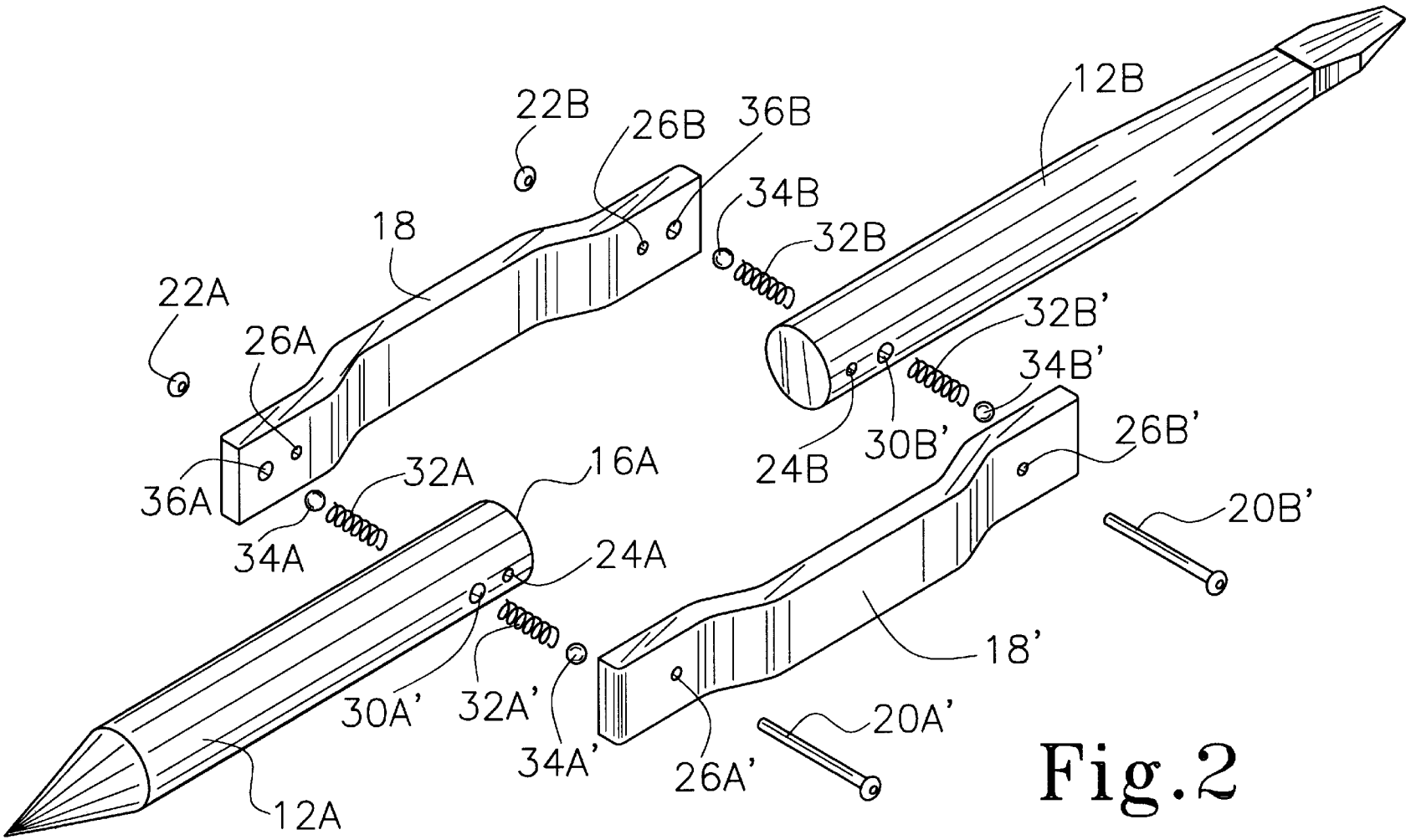
FIG. 2 illustrates an exploded perspective view of the combination chisel and punch.

FIG. 2 illustrates an exploded view of the combination chisel and punch 10. Each link member 18 includes a pair of through-openings 26 and a pair of detents 36. In illustrated embodiment, each link members 18 is bent to increase the rigidity should either link member 18 be struck during use. Additionally, one skilled in the art will recognize that the increased distance between the first link member 18 and the second link member 18' resulting from the bend allows for the diameter of striking end 15 of each tool member 12 to be increased whether intentionally enlarged to provide a larger striking surface 16 or unintentionally deformed by repetitive striking forces. Further, one skilled in the art will recognize that each link member 18 can have other shapes, such as a unbent link.

The first tool member 12A is pivotally connected to each link member 18 by a first link pin 20A. The first link pin 20A defines an axis about which the first tool member 12A rotates. The second tool member 12B is pivotally connected to each link member 18 by a second link pin 20B. The second link pin 20B defines an axis about which the second tool member 12B rotates.

The link pins 20 are received by cooperating through openings 24,26 defined by each tool member 12 and the link 18 respectively. In the preferred embodiment, each link pin 20 is a rivet, having a rivet head 22A for permanent attachment. However, one skilled in the art will recognize that a nut-and-bolt or similar assembly allows the combination chisel and punch 10 to accommodate interchangeable tool members.

Figure 3:
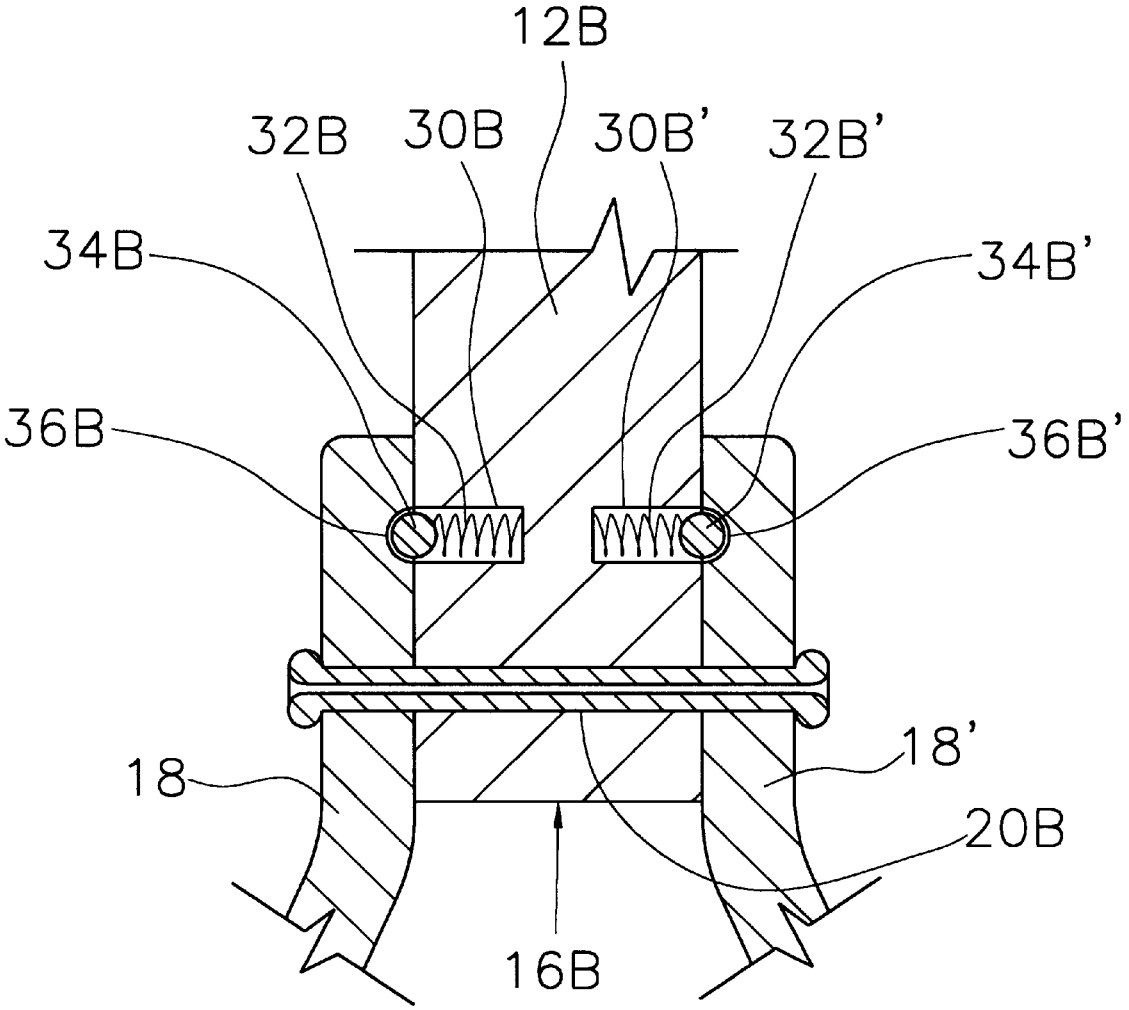
FIG. 3 illustrates an enlarged side elevation view, in section, detailing the connection between the tool member and the link of the combination chisel and punch taken at 3—3 of FIG. 1.

Further, the combination chisel and punch 10 contains at least one lock mechanism, illustrated in detail in FIG. 3 for holding each tool member 12 in an extended position. The lock mechanism includes at least one radial opening 30 in each tool member 12, at least one detent 36 located on the inner surface of each link member 18, and at least one ball-bearing 34 biased toward each link member by a spring 32. Each radial opening 30 is axially parallel to each through opening 24 and extends to a depth less than the radius of each tool member 12. Each radial opening 30 is configured to receive a spring 32 and a ball-bearing 34. The spring 32 is seated in the neck of each radial opening 30 and exerts outward pressure on the ball-bearing 34 seated at the mouth of each radial opening 30. Each spring-biased ball-bearing 34 is physically retained by each link member 18. In the preferred embodiment, a pair of diametrically opposed radial openings 30 and a pair of spring-biased ball-bearings 34 are utilized.

In the illustrated embodiment, the inner surface of each end of each link member 18 defines a detent 36 configured to receive one of the spring-biased ball-bearings 34. When each tool member 12 is oriented parallel to each link member 18, the detent 36 is engaged by the spring-biased ball-bearing 34 locking the tool member 12 into position. In the preferred embodiment, a pair of detents 36 axially aligned with the pair of radial openings 30 is utilized. One skilled in the art will recognize that the lock mechanism could be included in each link member 18 and biased toward the tool members 12.

Figure 4:
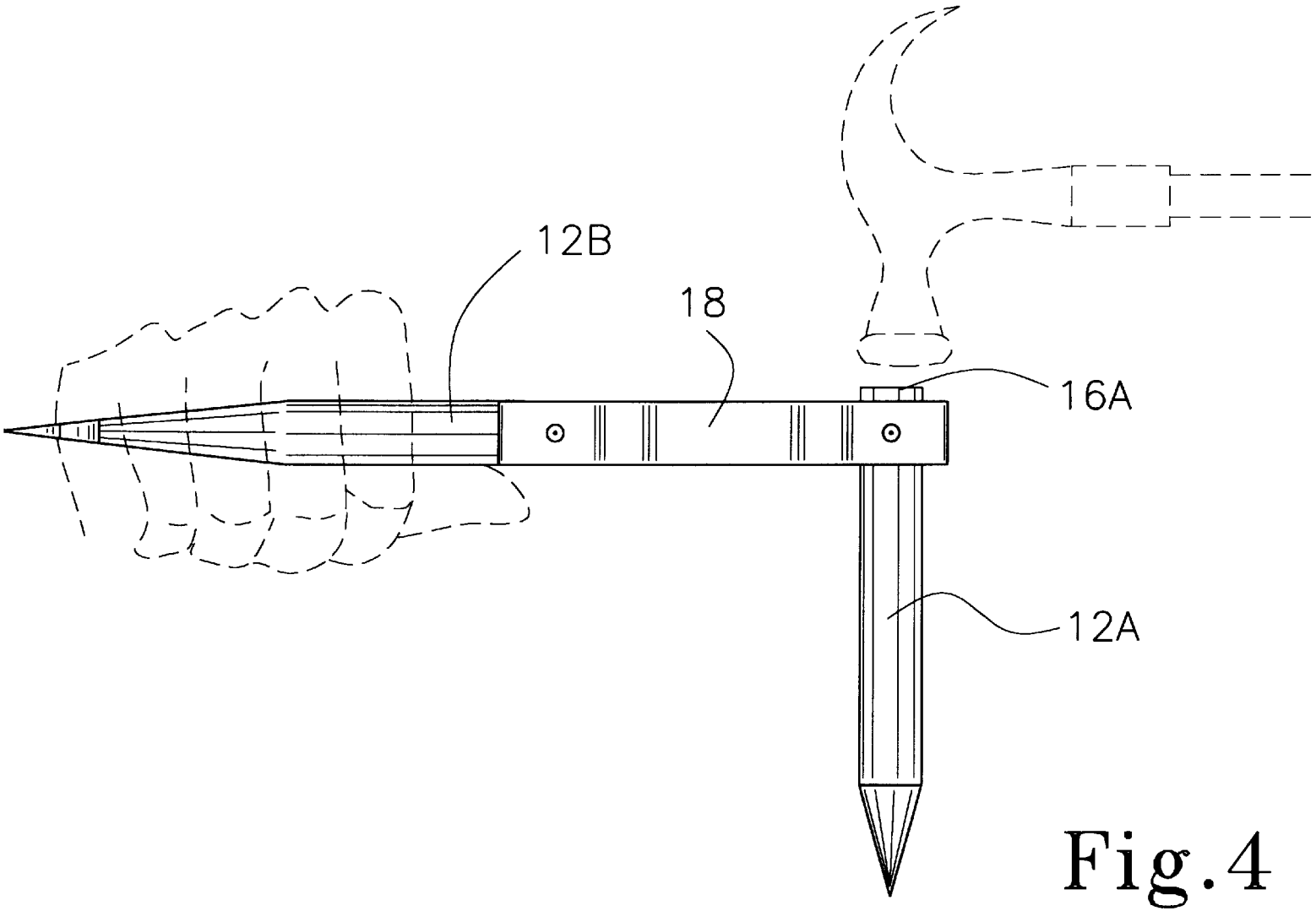
FIG. 4 illustrates the combination chisel and punch in use.
Figure 5:
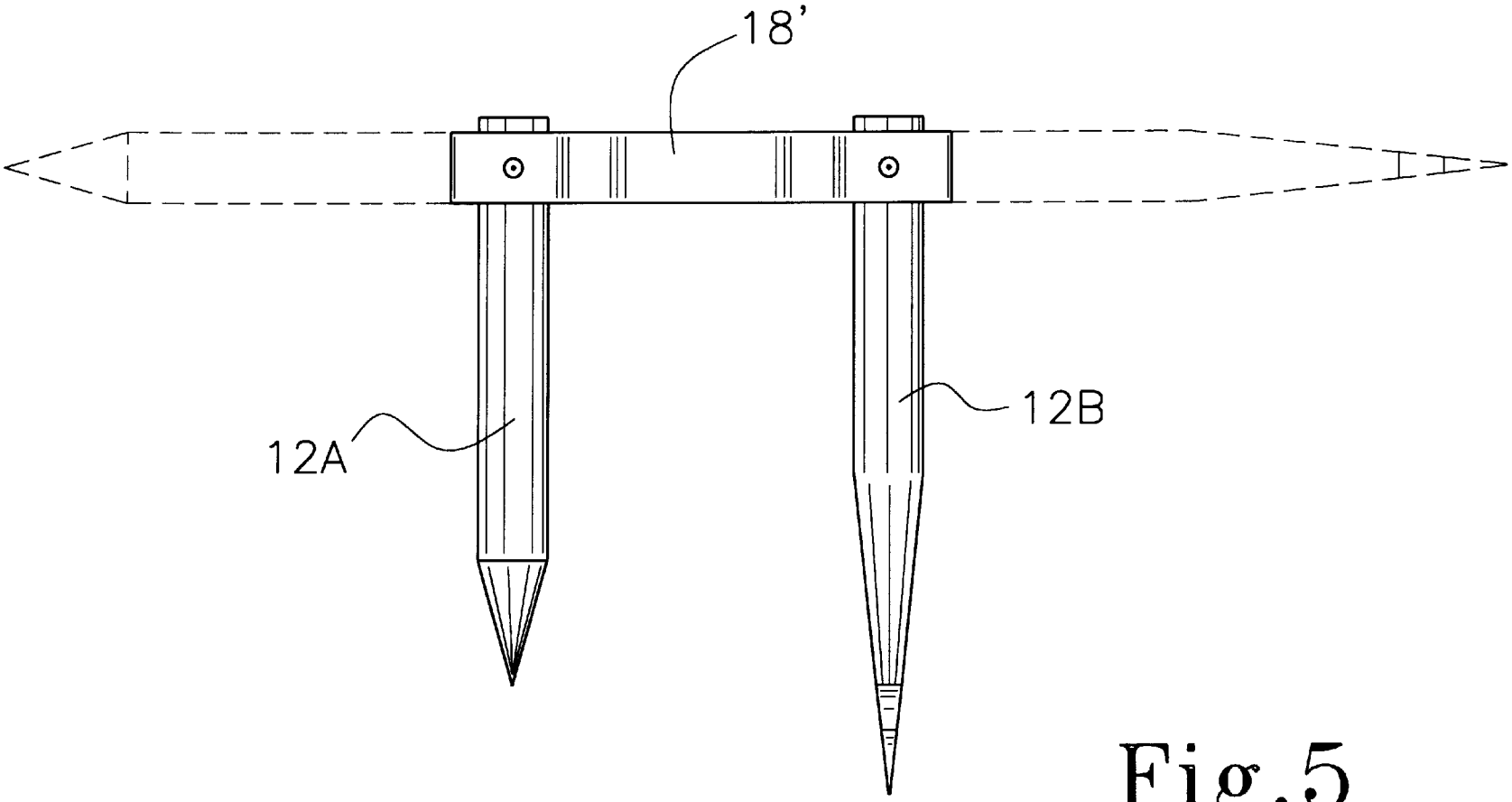
FIG. 5 illustrates the combination chisel and punch folded for storage.

The combination chisel and punch is shown in use in FIG. 4. During use, the tool member 12A to be struck is placed in the operative position, substantially perpendicular to each link member 18, and the tool member 12B to serve as a handle is placed in the locked position, parallel to each link member 18. While in the operative position, the striking end 15 of the tool member 12A extends above each link member 18 providing a striking surface 16A upon which to apply a downward striking force. When not in use, each tool member 12 can be folded into the unlocked position for compact storage, as shown in FIG. 5.

From the foregoing description, it will be recognized by those skilled in the art that a combination chisel and punch offering advantages over the prior art has been provided. Specifically, the tool provides increased safety by positioning the hand used to steady the tool away from the striking surface.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A combination tool device comprising:

a first elongated tool member having a striking end defining a surface for being struck by another object and a working end for engaging a work piece;

a second elongated tool member having a striking end defining a surface for being struck by another object and a working end for engaging a work piece;

a link for pivotally coupling said first and said second tool members, said link consisting of a first link member having a first end and a second end and a second link member having a first end and a second end, said first link member disposed on a first side of said first tool member and said second tool member and said second link member disposed on a second side of said first tool member and said second tool member, a channel being defined between said first link member and said second link member for receiving at least a portion of each of said first tool member and said second tool member including each said striking end; and at least one lock mechanism for independently engaging at least one of said tool members in a locked position at an orientation parallel to said link.

2. The combination tool device of claim 1 wherein said first working end and said second working end are selected from the group consisting of at least a chisel tool, a punch tool, and a handle.

3. The combination tool device of claim 1 wherein said first tool member is pivotable into an operative position substantially perpendicular to said link such that said first striking end extends above said link, said second tool member being disposed in said locked position for gripping while said first striking surface is being struck and wherein said second tool member is pivotable into an operative position substantially perpendicular to said link such that said second striking end extends above said link, said first tool member being disposed in said locked position for gripping while said second striking surface is being struck.

4. The combination tool device of claim 1 wherein said first tool member and said second tool member are pivotally connected to said link using a link pin received by cooperating through-openings defined by said first striking end, said second striking end, said first link member, and said second link member.

5. The combination tool device of claim 1 wherein said lock mechanism includes at least one radial opening defined by either of each of said first tool member and said second tool member and each of an inner surface of said first link member and said second link member, at least one spring received within each said at least one radial opening, at least one ball-bearing received within each said at least one radial opening, and at least one detent defined by the other of each of said first tool member and said second tool member and each of said first link member inner surface and said second link member inner surface, each said spring being disposed within one said radial opening such that said at least one ball-bearing is outwardly biased towards said detent said at least one detent configured to receive said at least one ball-bearing.

6. The combination tool device of claim 1 wherein said channel has a width greater than a diameter of each of said first tool member and said second tool member.

7. The combination tool device of claim 1 wherein each of said first link member and said second link member define a bend at each of said first end and said second end, a first channel width being defined between said first link member and said second link member having a width approximately equal to the diameter of each of said first tool member and said second tool member, a second channel width being defined between said first link member and said second link member extending from said first end bend to said second end bend, said second channel width being greater than the diameter of each of said first tool member and said second tool member.

8. The combination tool device of claim 7 wherein said second channel width allows each of said first tool member and said second tool member to pivot between said first link member and said second link member where either of said first striking end and said second striking end define a diameter greater than a diameter of each of said first tool member and second tool member, respectively.

9. A combination tool device comprising:

a first elongated tool member having a striking end defining a surface for being struck by another object and a working end for engaging a work piece;

a second elongated tool member having a striking end defining a surface for being struck by another object and a working end for engaging a work piece;

a link for pivotally coupling said first and said second tool members, said link consisting of a first link member having a first end and a second end and a second link member having a first end and a second end, said first link member disposed on a first side of said first tool member and said second tool member and said link member disposed on a second side of said first tool member and said second tool member, a channel being defined between said first link member and said second link member for receiving at least a portion of each of said first tool member and said second tool member including said striking end; and at least one lock mechanism for independently engaging at least one of said tool members in a locked position at an orientation parallel to said link.

10. The combination tool device of claim 9 wherein said first working end and said second working end are selected from the group consisting of at least a chisel tool, a punch tool, and a handle.

11. The combination tool device of claim 9 wherein said first tool member is pivotable into an operative position substantially perpendicular to said link such that said first striking end extends above said link, said second tool member being disposed in said locked position for gripping while said first striking surface is being struck and wherein said second tool member is pivotable into an operative position substantially perpendicular to said link such that said second striking end extends above said link, said first tool member being disposed in said locked position for gripping while said second striking surface is being struck.

12. The combination tool device of claim 9 wherein said first tool member and said second tool member are pivotally connected to said link using a link pin received by cooperating through-openings defined by said first striking end, said second striking end, said first link member, and said second link member.

13. The combination tool device of claim 1 wherein said second channel width allows each of said first tool member and said second tool member to pivot between said first link member and said second link member where each of said first striking end and said second striking end have a diameter greater than that of each of said first tool member and second tool member, respectively.

14. The combination tool device of claim 9 wherein each of said first link member and said second link member define a bend at each of said first end and said second end, a first channel width being defined between said first link member and said second link member having a width approximately equal to a diameter of each of said first tool member and said second tool member, a second channel width being defined between said first link member and said second link member, said second channel width extending from each of said first end bends to each of said second end bends, said second channel width being greater than the diameter of each of said first tool member and said second tool member, wherein said second channel is configured to receive each of said first tool member striking end and said second tool member striking end.

* * * * *